United States Patent [19]

Smith et al.

[11] 4,228,767

[45] Oct. 21, 1980

[54] SELF CONTAINED BOILER PACKAGE UTILIZING ATMOSPHERIC FLUIDIZED BED COMBUSTION

[75] Inventors: Willard P. Smith; Harry J. Michaels, both of Spring Lake; Robert W. Shedd, Grand Rapids, all of Mich.

[73] Assignee: Johnston Boiler Company, Ferrysburg, Mich.

[21] Appl. No.: 5,072

[22] Filed: Jan. 22, 1979

[51] Int. Cl.[3] ..... F22B 1/02

[52] U.S. Cl. ..... 122/4 D; 110/245; 122/DIG. 10

[58] Field of Search ..... 122/4 D, 74, 75–78, 122/DIG. 10; 110/245, 263, 234; 431/7, 170

[56] References Cited

U.S. PATENT DOCUMENTS

| | | | |
|---|---|---|---|
| 2,707,942 | 5/1955 | Adams | 122/74 X |
| 3,080,855 | 3/1963 | Lewis | 122/4 D |

FOREIGN PATENT DOCUMENTS

| | | | |
|---|---|---|---|
| 2256378 | 7/1975 | France | 122/DIG. 10 |
| 1464410 | 2/1977 | United Kingdom | 122/4 D |

*Primary Examiner*—Edward G. Favors

*Attorney, Agent, or Firm*—Price, Heneveld, Huizenga & Cooper

[57] ABSTRACT

A fluidized bed combustion, unitized transportable fire tube boiler package supported by its framework and housed within an insulated housing that ducts incoming air to preheat it while serving as a noise abutment shield. The water and steam retaining pressure vessel has an upright lower portion tapered divergently upwardly and enclosing a like-configurated, fluidized bed combustion housing spaced therefrom to form a water jacket therebetween. The pressure vessel also has a horizontally elongated upper portion enclosing a plurality of sets of combustion-gas tubes interconnected by flow reversing end members and surrounded by water.

9 Claims, 5 Drawing Figures

SELF CONTAINED BOILER PACKAGE UTILIZING ATMOSPHERIC FLUIDIZED BED COMBUSTION

BACKGROUND OF THE INVENTION

This invention relates to fire tube boilers employing fluidized bed combustion.

Boilers employing fluidized bed combustion have been the subject of experimentation and development in recent years by several institutes including corporations and governmental agencies, both in the U.S. and abroad. Fluidized bed combustion offers significant potential in fuel savings, and in pollution control, especially of sulfur compounds. It would be desirable to have fluidized bed combustion available for boilers where lesser amounts of steam generation are required, such as at schools, factories, commercial buildings and the like. Such institutions usually have limited funds so that elaborate pollution controls are impractical and fuel usage should be optimized.

However, boilers by their nature are typically complex, requiring costly on-site assembly. If the on-site assembly involved fluidized bed combustion, the cost and problems could be prohibitive. What has been needed is a packaged fire tube boiler employing fluid bed combustion, factory assembled and pre-tested, and capable of employing any of multiple fuels available, even solid fuels such as coal or wood, enabling smaller users to have such installed, as a unit, to allow minimal installation costs, capacity to burn solid fuels, and resulting minimal pollution.

SUMMARY OF THE INVENTION

The inventors herein have succeeded in developing a unique practical fluidized bed combustion, fire tube boiler in a self-contained package capable of installation as a unit at a user's facility. It is capable of employing gas, oil and/or coal and other solid fuels, yet without grates, stokers and ash pits. No walls of refractory material are necessary around the combustion chamber. The integrated unit is factory constructed, pre-tested, and shipped as a complete package. It is contained within a housing which serves not only to enclose the integrated unit but also as a thermally insulated air flow plenum and a noise abatement shield. It optionally incorporates an integral cyclone collector for retaining particulate matter.

An important object of this invention therefore is to provide such an integrated, fluidized bed, fire tube boiler unit.

DESCRIPTION OF THE PREFERRED EMBODIMENT

Figure 1:
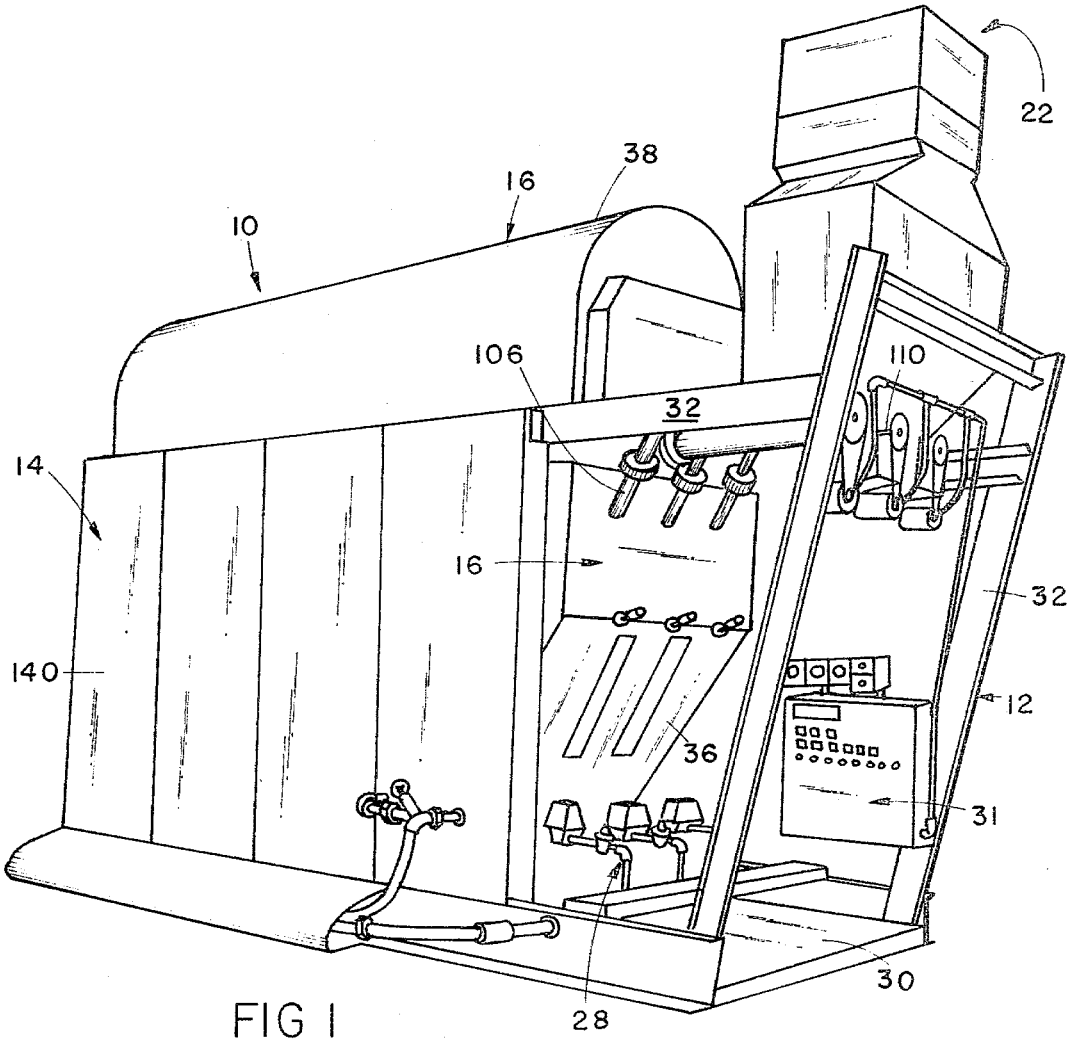
FIG. 1 is a perspective view of the novel fluid bed fire tube boiler unit or assembly.

Referring now particularly to the drawings, the preferred embodiment of the invention there depicted comprises a fluidized bed fire tube boiler assembly 10 encompassing a framework subassembly 12, an acoustical barrier, air flow directing enclosure subassembly 14, a pressure vessel subassembly 16, containing a fluidized bed combustion chamber subassembly 18, a combustion gas flow tube subassembly 20, and coal and limestone infeed subassembly 22.

Framework subassembly 12 is made up of an underlying support platform 30 to which is mounted an upstanding skeletal frame 32, to enclose and support the operating components. The remaining components of apparatus 10 are on this platform and within this frame, forming an integrated unit which is factory fabricated and shipped as a packaged unit to be installed at a user's facility.

Figure 5:
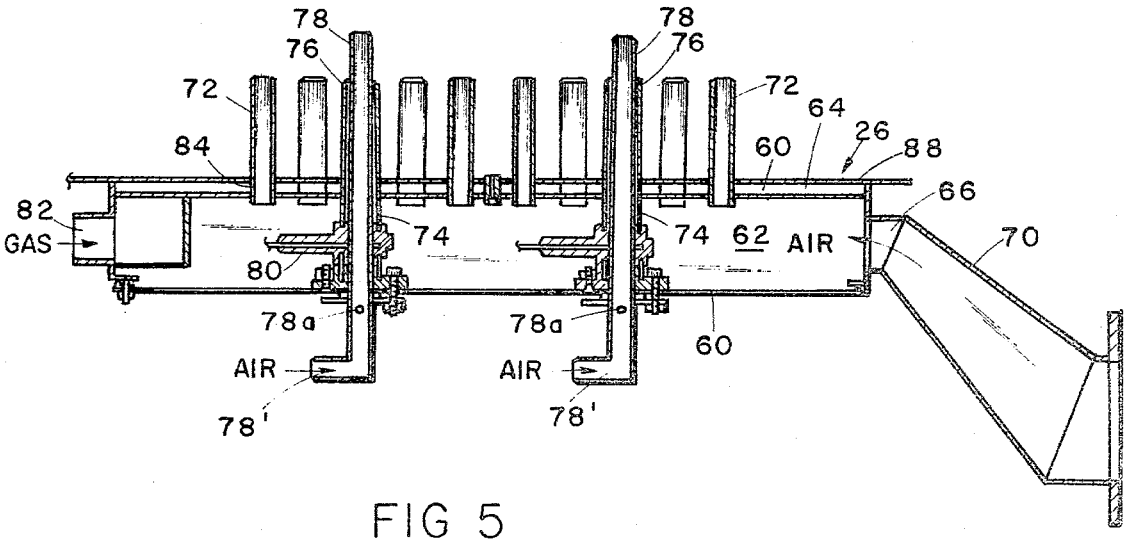
FIG. 5 is an enlarged fragmentary elevational view of one of the three distributors for the fluidized bed of the apparatus.
Figure 4:
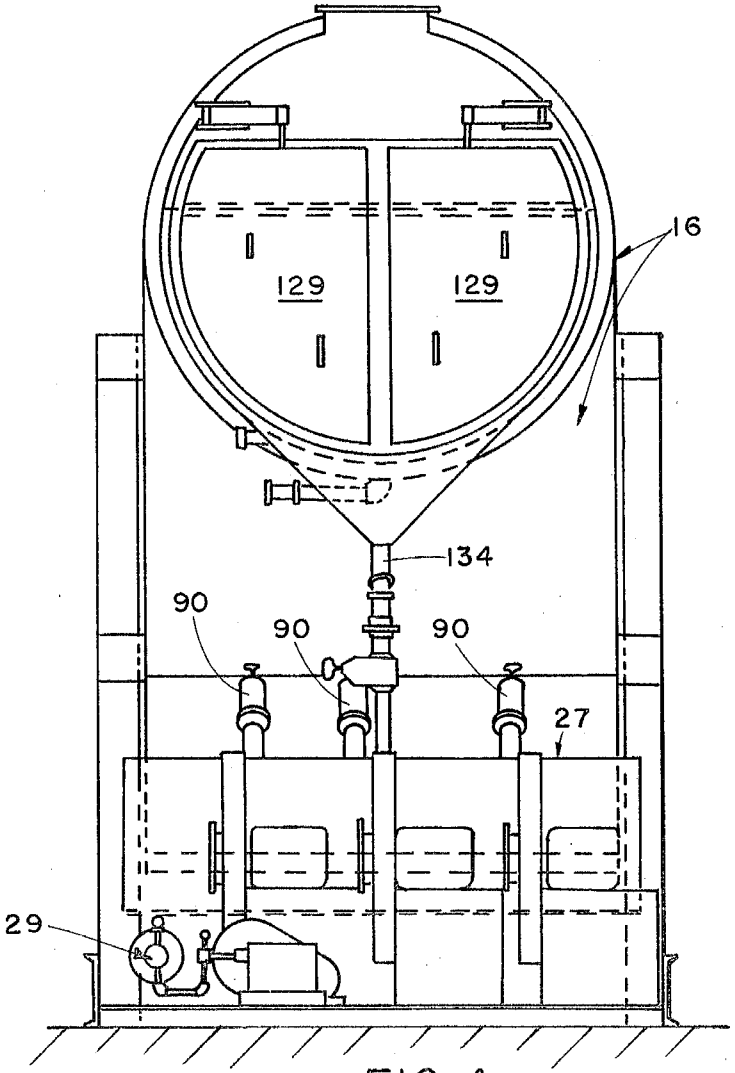
FIG. 4 is an end elevational view of the apparatus in FIG. 2, viewed from the right end.

Positioned within the lateral confines of frame 32 and secured thereto is the pressure vessel subassembly 16. It comprises an L-shaped pressure vessel having an upstanding lower portion 36 integrally connected with a horizontally extending upper portion 38. At the top of this pressure vessel is a steam outlet 40 with connecting means for attachment to steam pipes, an access port with closure 42, and safety relief valves 44. Hoisting rings 46 are provided on the top of the vessel forming attachment means for lifting the entire assembly as by a crane for transportation and installation. Mounted within the lower upright portion 36 of the pressure vessel is the fluidized bed combustion chamber subassembly 18. This includes a chamber housing 50, the lower portion of which retains the conventional fluidized bed material such as silica sand or the like. This lower portion has two opposite side walls 50' which are downwardly convergent, i.e. upwardly divergent. At the bottom of walls 50', the cross sectional area of the chamber is a fraction, preferably about one-half, of the area at the top of these walls 50'. The bottom of this chamber is enclosed by a plurality, here three, of fluid bed distributor subassemblies 26 (FIG. 5). Communicant with these distributor subassemblies is an air propelling subassembly 27, gas fuel supply means 28 (FIG. 2) and oil fuel supply means 29 (FIG. 4).

Each distributor subassembly 26 includes a manifold housing 60 having a main chamber 62 and a secondary upper chamber 64. Compressed air is supplied to each subassembly. E.g., a compressed air inlet 66 is connected to the main chamber from the compressed air supply means 27. More specifically, blowers may be used, such as one blower for each subassembly. Here two of the three blowers, 68 and 68', are depicted. They propel air from their respective intakes **68*a* and 68'*a* through ducts 70 containing electrical heaters 72, as to the inlet port 66 to plenum 62. From there the air flows under pressure up the fluidizing stand pipe nozzles 72 extending up into the combustion chamber. The nozzles have outlet openings at the tops thereof. The air also flows through inlet ports 74 of outer jackets 76 of the stand pipe oil nozzles 78. Compressed air is also supplied from a source which may be separate from those shown through these stand pipe oil nozzles through inlets 78'. There is a liquid oil inlet orifice 78*a* downstream of inlet 78' on each oil nozzle and pipe, and upstream of the outlet of this nozzle into the combustion chamber so that the air conveys the oil as a film up the wall of the nozzle in a manner set forth in U.S. Pat. No. 3,958,916. Each of these oil nozzles may be provided with an emergency gate valve 80 for closing off the outer sleeve 76** when the inner nozzle tube is withdrawn downwardly as for cleaning or the like.

A gas fuel inlet 82 is provided to the plenum 64 for flow through ports 84 into upstanding nozzles 72 for entrainment of the gaseous fuel with the air passing through these nozzles from manifold plenum 62.

Figure 3:
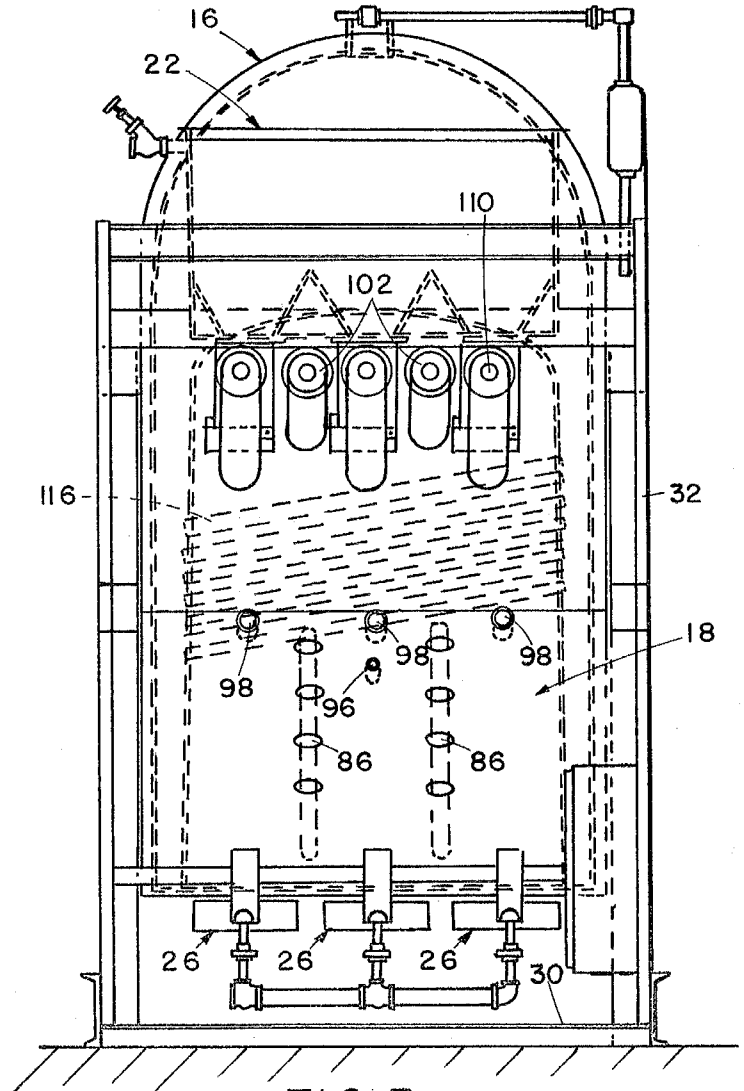
FIG. 3 is an end elevational view of the apparatus in FIG. 2 viewed from the left end.

The fluidizable bed particulate material such as silica sand rests upon the upper surface 88 of this distributor. The portion of the sand above the outlet of the upstanding pipe is subject to fluidization during operation. The three distributors form three bed zones in the combustion chamber. These bed zones are generally separated by vertical partitions formed of vertically spaced tubes or pipes oriented generally horizontally, at a slant, and extending between and through the opposite tapered walls 50' of the combustion chamber. These divider pipes are thus in two groups of pipes 86 (FIG. 3) forming three side-by-side combustion chamber zones to be cooperative respectively with the three distributor subassemblies 26. The opposite open ends of these tubes 86 project into the peripheral space 88 surrounding the combustion chamber housing. This space is within the lower portion 36 of the pressure vessel between the combustion chamber housing and the pressure vessel lower portion. The diagonal slant causes water to flow by gravity therethrough to remove heat from the combustion chamber and prevent overheating of the tubes.

The depth of the bed within each combustion chamber zone, during fluidization, is controlled by an overflow tube 90 from the top part of each chamber zone, its inlet being adjacent the upper end of the tapered walls 50', and its outlet being in a suitable receiver such as receptacle 92. Flow of the fine particulate matter through conduit 90 can be controlled by a gate valve 94. If desired, this particulate matter may be recycled back into the bed.

At least one pilot igniter 96 is provided, as to the central chamber zone. Optionally pilot lights can be provided to each chamber zone. View ports 98 containing a transparent closure are also provided for each chamber zone.

Coal fuel infeed means is also provided as noted briefly above. Specifically, a coal chute 100 has power feed augers 102 communicant with the lower end thereof. These are driven by motors to advance coal down chutes 106 into the combustion chamber zones. Since coal often contains sulfur, infeed means for a sulfur compound retention material such as limestone is also provided. Specifically, a limestone chute 108 is communicant with powered augers 110 (FIG. 3) to discharge limestone into the combustion chamber zones.

Figure 2:
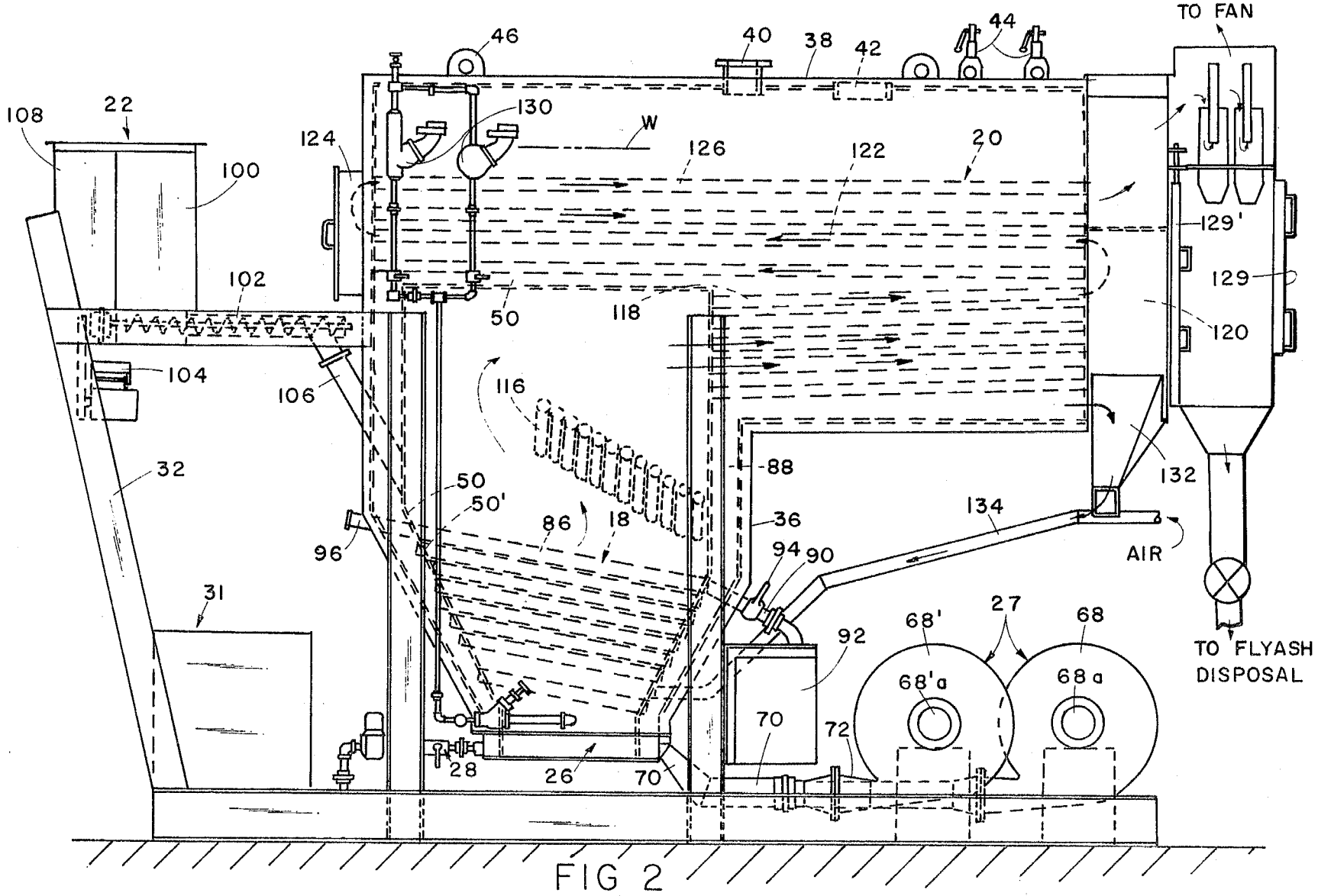
FIG. 2 is a side elevational view of the apparatus in FIG. 1, with the outer enclosure removed.

Within the combustion chamber and above the bed level is a baffle arrangement formed by a series of diagonally oriented tubes or pipes 116 (FIG. 2). These lie in vertical planes which are generally normal to the vertical planes of tubes or pipes 86, and are thereabove. Tubes 116 extend generally horizontally through the opposite vertical sidewalls of chamber 50 to allow water to folw therethrough. They are vertically sloped, i.e. on an angle to cause water to flow through them by gravity as it is heated during passage. These tubes are offset horizontally and vertically from each other, adjacent each other, to form a diagonal sloping baffle means. This forces the combustion air from the bed to flow upwardly and outwardly around the baffle and then back toward the ports in the ends of hot-combustion-gas-conducting fire tubes 118 communicant with the upper end of chamber 50. I.e., the baffle is in the direct path between the bed and the outlets. Thus, the combustion gases must flow generally in a flow pattern around these tubes, causing the particulate matter to precipitate. Any particulate matter which drops upon tubes 116 can tumble to the end of the baffle and drop back into the fluid bed, or optionally fall through the small spaces between the tubes and back into the bed.

The hot combustion gas tubes are formed in sets, each set conducting gases in an opposite direction to the adjacent one, with three such sets being shown in this embodiment. Specifically, the shorter set of tubes 118 project from the upper end of the combustion chamber to one end of the horizontally elongated upper portion 38 of the pressure vessel where they terminate into a flow reverser 120. The gases pass out of these tubes 118 of the first set, reverse, and flow into the second set of tubes 122. At this reversal zone, any carbon particles still retained by the gases tend to precipitate into chute 132, to be carried by air from a source (not shown) through conduit 134 back to the bed. Tubes 122 extend from flow reverser 120 to the opposite end of the horizontal portion 38 to a second flow reverser 124. The gases then again reverse direction and flow through the third set of tubes 126 to chamber 128 where they are preferably treated by a cyclone-type precipitator 130 within the unit, to cause any residual particulate matter to drop to a chute for disposal. Access to these components may be had through outer doors 129 and inner doors 129'.

The level of water in the pressure vessel is controlled, by typical water level control units 130, at a level shown by the phantom line at W in FIG. 2. The water in the pressure vessel surrounds the combustion chamber housing and the fire tubes as well as filling tubes 86 and tubes 116. This arrangement not only transfers heat to the water for conversion into steam, but also constantly cools the combustion chamber to prevent the usual necessity in boilers of refractory lining. Accordingly, the complete fluidized bed fire tube boiler assembly is relatively lightweight and compact compared to its conventional counterpart.

The enclosure subassembly 14 constitutes a series of vertical panels 140 mounted to frame 32. These panels have thermal insulation. Air drawn to blowers 68 and 68' thus is channeled down over the warm outer periphery of the boiler components to preheat such air before it is conducted to the combustion chamber. The panels are spaced outwardly from the pressure vessel to form air ducts. Acoustical material on the panels serve to attenuate noise from the assembly during operation, to thereby provide an acoustical barrier.

The boiler may be regulated and monitored with instrumentation associated with a control panel 31.

The fluidized bed combustion operation is typically initiated using gaseous fuel. Gas is introduced into inlet 82 (FIG. 5) of the central distributor while compressed air is introduced into inlet 66 so that, as the compressed air passes through plenum 62 up through tubes 72, and gas is introduced into orifices 84 of tubes 72, the emerging combustible mixture not only forces the particulate fluidizable bed material into suspension but also is ignitable by the pilot 96. Once this chamber zone is heated up, the adjacent straddling bed sections can be subsequently ignited by forcing the combustible mixture up through their respective distributors, the spacing between the tubes 86 allowing flame propagation from the central bed. One, two or three of these beds can be operated selectively depending upon the amount of heat output required for the particular usage involved. Moreover, if it is desired to change the output from each individual bed section, the volume of fuel and air ejected from an individual distributor can be varied. Specifically, since two opposite walls of each combustion chamber zone taper upwardly outwardly astraddle each bed section, with the area at the top being double that at the bottom, the flow rate through each bed section has a potential turn up or turn down ratio of two to one. And, as the volume of gas and air is increased, the flow velocity will decrease in proportion to the increased flow area through which it is passing, so that the velocity of the gases emerging from the bed will stay basically constant. It is desirable that this velocity remain substantially constant even though the flow rate is varied, to maintain the desirable fluidizing velocity appropriate to the size distribution of particulate bed material.

If the gas fuel is to be substituted by oil-type fuels, compressed air is ejected through ports 78' of tubes 78, as well as through plenum 62 into jackets 76 surrounding tubes 78, while liquid oil is introduced into ports **78*a***. Typically this is not done until the temperature of the bed reaches approximately 360° C. using gaseous fuel.

If it is desired to employ particulate coal fuel, it is injected in controlled amounts into the combustion chamber using the chute and auger subassembly depicted, along with a controlled amount of limestone or other sulfur retention agent.

As the fluidized bed functions, the combustion gases flow up around the baffle formed by tubes 116 and out the first set of tubes 118, reverse at 120 and flow through tubes 122, reverse at 124 and flow through tubes 126 to precipitator 130, and then out the stack. The water surrounding the combustion chamber is heated and flows up by gravity, as well as water flowing by gravity through diagonal tubes 86 and baffle tubes 116. Further, heat is transferred to the water surrounding tubes 118, 122 and 126.

This entire assembly can be fabricated as an integrated unit at the boiler factory, hoisted by lift rings 46 onto a transport vehicle such as a truck or flat car, and later removed and positioned at the site ready for operation upon hookup to a water line, to fuel supplies, i.e. gas, oil and/or coal, and to electrical power.

The embodiments of the invention in which an exclusive property or privilege is claimed are defined as follows.

1. A unitized fluidized bed combustion fire tube boiler assembly comprising:

a supporting frame having a platform base and skeletal structure thereon;

a pressure vessel on said frame, having a lower upright portion with upright walls, and an upper horizontal portion, both portions collectively defining a water and steam chamber;

a fluidized bed combustion housing in said lower upright portion, spaced inwardly from said pressure vessel upright walls; a distributor in said housing, having fuel inlets and combustion and suspension air inlets;

a plurality of sets of horizontal, spaced, elongated, combustion-gas tubes in said pressure vessel upper portion, in flow communication with said fluidized bed combustion housing to conduct hot combustion gases, flow reversing chambers on opposite ends of said upper portion, in communication with adjacent sets of said combustion-gas tubes to receive gases from one set of tubes, reverse the flow thereof, and discharge the gases in the adjacent set of tubes;

means on said supporting frame for supplying combustion air and bed fluidizing air to said fluidized bed combustion housing; and an enclosure on said frame about and spaced from said pressure vessel forming air flow ducting around said pressure vessel to said means for supplying combustion air and fluidizing air, thereby preheating the air thereto.

2. The unitized assembly in claim 1 including attachment means for lifting said assembly.

3. The unitized assembly in claim 1 including particulate fuel feed means to said fluidized bed combustion housing.

4. The assembly in claim 1 wherein said upright walls of said fluidized bed combustion housing are upwardly divergent for maintaining a predetermined air velocity through the bed over a range of fuel and air input rates.

5. The assembly in claim 4 wherein said fluidized bed combustion housing is separated into a plurality of adjacent beds having independent fuel inlets and air inlets.

6. The assembly in claim 1 including a series of adjacent baffle pipes in said housing for forming a particle retention baffle to retain particles in said fluidized bed combustion housing.

7. The assembly in claim 1 including particle separation means downstream of the last of said sets of tubes for separating particles out of the combustion gases; and particle reinjection means from said particle separation means to said vessel for reinjecting particles into said vessel.

8. The assembly in claim 1 wherein said enclosure has thermal insulation.

9. The assembly in claim 1 wherein said enclosure includes acoustical absorption material forming a noise barrier.

* * * * *

UNITED STATES PATENT AND TRADEMARK OFFICE

CERTIFICATE OF CORRECTION

PATENT NO. : 4,228,767

DATED : October 21, 1980

INVENTOR(S) : Willard P. Smith, Harry J. Michaels, Robert W. Shedd

It is certified that error appears in the above-identified patent and that said Letters Patent are hereby corrected as shown below:

In the Abstract, Line 4:

"abutment" should be ---abatement---

Column 3, line 63:

"folw" should be ---flow---

Signed and Sealed this

*Seventeenth* Day of *March 1981*

[SEAL]

*Attest:*

RENE D. TEGTMEYER

*Attesting Officer*

*Acting Commissioner of Patents and Trademarks*